US007868237B1

(12) United States Patent
Quilon

(10) Patent No.: US 7,868,237 B1
(45) Date of Patent: Jan. 11, 2011

(54) LOW VOLUME DRUM STICK

(76) Inventor: Lazaro Quilon, 316 Elilani St., Pukalani, HI (US) 96768

( * ) Notice: Subject to any disclaimer, the term of this patent is extended or adjusted under 35 U.S.C. 154(b) by 0 days.

(21) Appl. No.: 12/392,990

(22) Filed: Feb. 25, 2009

Related U.S. Application Data

(60) Provisional application No. 61/031,632, filed on Feb. 26, 2008.

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS

| | | | | |
|---|---|---|---|---|
| 3,301,119 | A | 1/1967 | Gilbert | |
| 3,422,719 | A * | 1/1969 | Payson | 84/422.4 |
| 4,202,241 | A | 5/1980 | Lucas | |
| 4,557,176 | A | 12/1985 | Boturia | |
| 4,632,006 | A | 12/1986 | Ambroszewski | |
| 5,263,395 | A | 11/1993 | Phillips | |
| 5,693,900 | A | 12/1997 | Calato et al. | |
| 5,925,840 | A | 7/1999 | Senn | |
| 7,084,339 | B2 | 8/2006 | Rundle | |
| 7,687,700 | B1 * | 3/2010 | Torres | 84/422.4 |
| 2004/0231493 | A1 | 11/2004 | Milne et al. | |
| 2006/0081117 | A1 | 4/2006 | Rundle | |
| 2006/0243118 | A1 | 11/2006 | Malott | |
| 2007/0068363 | A1 | 3/2007 | Seymour | |

FOREIGN PATENT DOCUMENTS

| | | | |
|---|---|---|---|
| WO | WO88/00753 | A1 | 7/1987 |
| WO | WO99/63518 | A1 | 5/1999 |
| WO | WO03/005338 | A1 | 1/2003 |

* cited by examiner

*Primary Examiner*—Kimberly R Lockett
(74) *Attorney, Agent, or Firm*—QuickPatents, Inc.; Kevin Prince

(57) ABSTRACT

A striker is disclosed for striking a percussion instrument, such as a drum or symbol. At least one elongated semi-rigid rod has a proximal end and a distal end. An elongated tubular core section is included that has a proximal end and a distal end. Each rod is slidably receivable in the distal end of the core section. In one embodiment, at least one handle sleeve is fixed around the proximal end of the core section. In another embodiment, an elongated tubular handle section having a proximal end and a distal end is included. The proximal end of the core section is fixedly receivable in the distal end of the handle section. In such an embodiment, each handle sleeve is fixed around the proximal end of the handle section instead of the core section.

7 Claims, 2 Drawing Sheets

LOW VOLUME DRUM STICK

CROSS-REFERENCE TO RELATED APPLICATIONS

This application claims the benefit of U.S. Provisional Patent Application 61/031,632, filed on Feb. 26, 2008, and incorporated herein by reference.

STATEMENT REGARDING FEDERALLY SPONSORED RESEARCH AND DEVELOPMENT

Not Applicable.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

FIELD OF THE INVENTION

This invention relates to percussion instruments, and more particularly to a volume-dampening drumstick for drum playing.

DISCUSSION OF RELATED ART

Drummers have traditionally only been able to play drums with conventional wooden drum sticks. Such drum sticks have a tip, a neck, and a solid-core handle. When trying to play quietly, however, such as when practicing at home or in an otherwise noise-sensitive environment, or when playing in a low-volume venue such as a jazz club, for example, traditional drumsticks can be overbearing.

Several prior art devices have been developed to allow for quieter drum striking. For example, U.S. Pat. No. 4,557,176 to Boturla on Dec. 10, 1985 teaches a hollow thermoplastic practice drumstick. Such a device, being made from a thermoplastic material, results in a quieter impact between the drumstick and the drum head, which allows such a device to be used for drumming practice on a conventional drum kit without making excessive noise. However, such a device is not adjustable, and provides only one type of practice sound.

U.S. Pat. No. 3,301,119 to Gilbert teaches a drumstick with replaceable hollow or solid tips. However, such a device is not designed to reduce playing volume, but only to provide more durability than conventional drumsticks while maintaining the balance and weight of conventional drumsticks. The interchangeable tips provided in such a device are substantially rigid and are designed to produce a loud impact noise with a drum head.

US Patent Application 2004/0231493 to Milne et al. on Nov. 25, 2004 teaches another drumstick with interchangeable components. Such interchangeable components serve to provide varying types of impact sounds, depending on the type of music being played, and different weighting elements in order to adjust the balance and feel of such a device while being played. Providing interchangeable tips that reduce the impact volume, such as during practice in a noise-sensitive environment, is not contemplated.

US Patent Application 2006/0081117 to Rundle on Apr. 20, 2006 teaches a drumstick device suitable for use as a hybrid conventional drumstick and a brush-type drumstick. Such a device, however, does not produce a conventional drum sound at a lower volume than a regular drumstick, but rather produces a unique sound due to a plurality of peripheral dowels impacting around a central core. Such a device is not adjustable in terms of the sounds it is able to produce.

Finally, US Patent Application 2006/0243118 to Malott on Nov. 2, 2006 teaches a drumstick having a retractable and replaceable tip. Such a device is designed to selectively produce either high or low tones, based on an extension distance of the tip. Such a device, however, does not produce low-volume tones.

Therefore, there is a need for a drumstick that allows the volume of the impact between a tip of such a device and a drum head to be easily and selectively adjusted. Such a needed device would have a weight, balance and feel that is substantially similar to a conventional drumstick, yet would be more durable, relatively inexpensive to manufacture, and capable of producing a variety of soft, low-volume sounds. Such a needed product would provide for various materials of impact tips that result in a wide range of low-volume tones. The present invention accomplishes these objectives.

SUMMARY OF THE INVENTION

The present device is a striker for striking a percussion instrument, such as a drum or symbol. At least one elongated semi-rigid rod has a proximal end and a distal end. An elongated tubular core section is included that has a proximal end and a distal end. Each rod is slidably receivable in the distal end of the core section.

In one embodiment, at least one handle sleeve is fixed around the proximal end of the core section. In such an embodiment, more than one rod may be slidably received by the distal end of the core section and fixed therein with a forward sleeve fixed substantially therearound. Preferably the forward sleeve includes an adhesive on an inside surface therein for bonding the forward sleeve around the core section and at least partially around each semi-rigid rod.

In another embodiment, an elongated tubular handle section having a proximal end and a distal end is included. The proximal end of the core section is fixedly receivable in the distal end of the handle section. In such an embodiment, each handle sleeve is fixed around the proximal end of the handle section instead of the core section. Such a sleeve includes the adhesive on an inside surface thereof for bonding the sleeve around the handle section.

The proximal end of the core section may include threads cooperative with internal threads formed in the distal end of the handle section to that the handle section and the core section may be screwed together in coaxial alignment. A junction sleeve may be fixed around a junction between the core section and the handle section. Such a junction sleeve includes the adhesive on an inside surface thereof for bonding the junction sleeve at least partially around the core section and the handle section. Further, preferably the forward sleeve is fixed substantially around the core section in such an embodiment, and at least partially around each semi-rigid rod and at least partially around the handle section. Alternately, the forward sleeve may just slightly contact each rod, if at all, and standard masking tape may be used to selectively hold each rod in the core section at a selected relative position.

The present invention is a drumstick that allows the volume of the impact between a tip of such a device and a drum head to be easily and selectively adjusted. The present invention has a weight, balance and feel that is substantially similar to a conventional drumstick, yet is more durable, is relatively inexpensive to manufacture, and is capable of producing a variety of soft, low-volume sounds. The present device provides for various materials of impact tips that result in a wide range of available low-volume tones. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
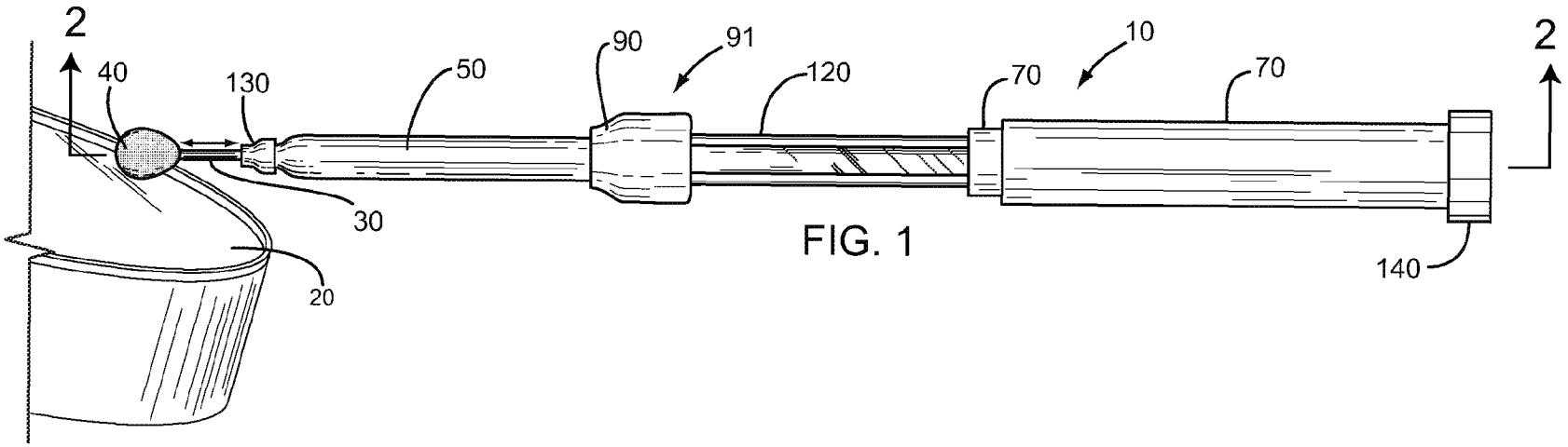
FIG. 1 is a perspective view of one embodiment of the invention.
Figure 2:
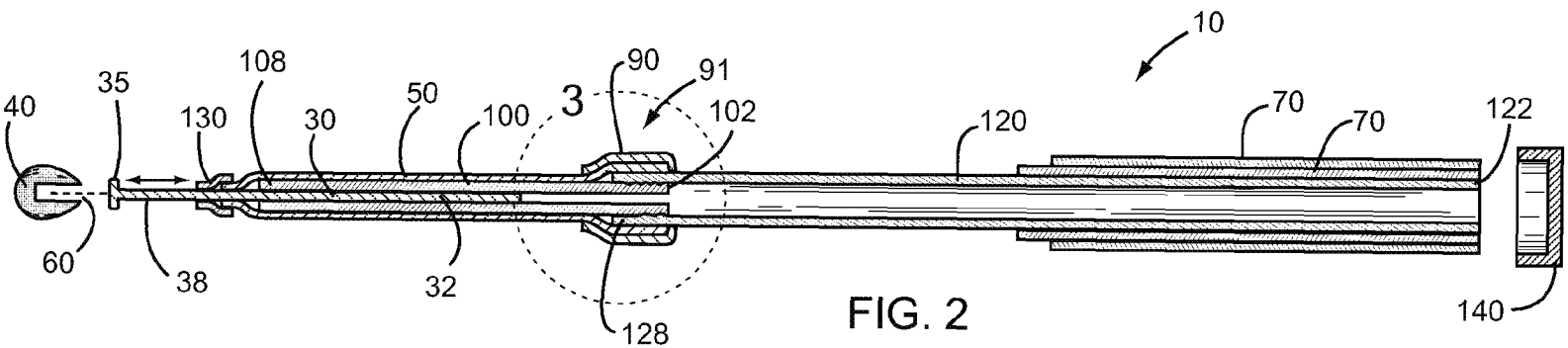
FIG. 2 is a cross-sectional view thereof, taken generally along lines 2-2 of FIG. 1.

FIGS. 1 and 2 illustrate a striker 10 for striking a percussion instrument 20, such as a drum or symbol. At least one elongated semi-rigid rod 30 has a proximal end 32 and a distal end 38. Each semi-rigid rod 30 is preferably a hollow polypropylene tube, but may also be a solid resilient material such as nylon, polypropylene, polyethylene, polycarbonate, or any other similar semi-rigid synthetic or natural material.

An elongated tubular core section 100 is included that has a proximal end 102 and a distal end 108. Each rod 30 is slidably receivable in the distal end 108 of the core section 100. The core section 100 is preferably made from transparent polycarbonate tube stock, but may also be made from other high-impact semi-rigid to rigid materials such as polycarbonate, styrene, polystyrene, polyethylene, and the like.

Figure 4:
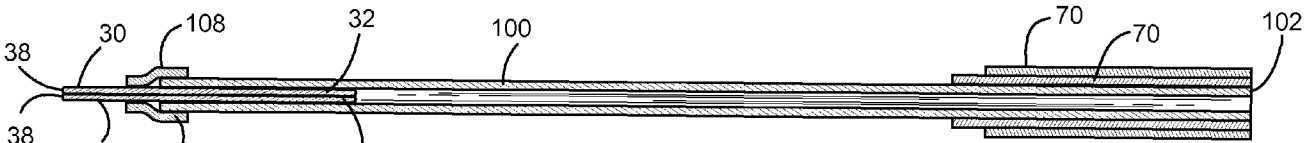
FIG. 4 is a cross-sectional view of a second embodiment of the invention, taken generally along lines 2-2 of FIG. 1.
Figure 7:
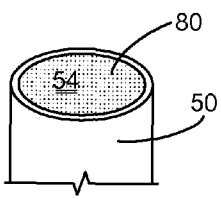
FIG. 7 is a perspective view of a forward sleeve of the invention.

In one embodiment, at least one handle sleeve 70 is fixed around the proximal end 102 of the core section 100 (FIG. 4). In such an embodiment, more than one rod 30 may be slidably received by the distal end 108 of the core section 100 and fixed therein with a forward sleeve 50 fixed substantially therearound. Preferably the forward sleeve 50 includes an adhesive 80 (FIG. 7) on an inside surface 54 therein for bonding the forward sleeve 50 around the core section 100 and at least partially around each semi-rigid rod 30. Such a sleeve 50 may be a dual wall flexible polyolefin with a thick wall polyamide adhesive, such as that sold under the brand name Sumitube W3B2 by Cable Markers Co. Inc. of Lake Forest, Calif., for example. Alternately, the forward sleeve 50 may just slightly contact each rod 30, if at all, and standard masking tape 130 (FIG. 2) may be used to selectively hold each rod 30 in the core section 100 at a selected relative position.

Figure 3:
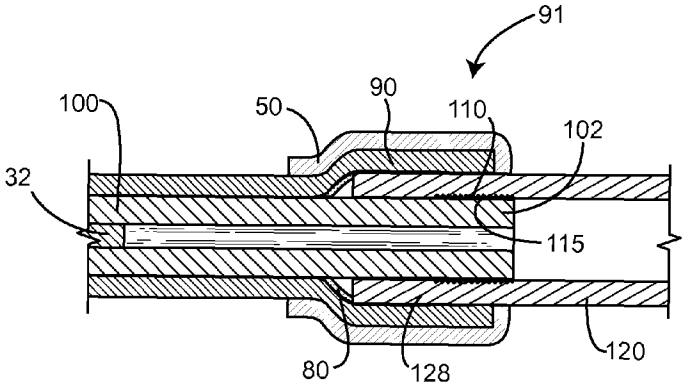
FIG. 3 is an enlarged sectional view of a joint thereof.

In another embodiment, illustrated in FIGS. 1-3, an elongated tubular handle section 120 having a proximal end 122 and a distal end 128 is included. Such a handle section 120 is preferably made from transparent polycarbonate tube stock material, but may also be made from polycarbonate, styrene, polystyrene, polyethylene, and the like.

Figure 5:
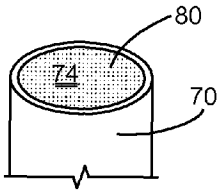
FIG. 5 is a partial perspective view of a handle sleeve of the invention.

The proximal end 102 of the core section 100 is fixedly receivable in the distal end 128 of the handle section 120. In such an embodiment, each handle sleeve 70 is fixed around the proximal end 122 of the handle section 120 instead of the core section 100. Such a sleeve 70 includes the adhesive 80 on an inside surface 74 thereof (FIG. 5) for bonding the sleeve 70 around the handle section 120.

The proximal end 102 of the core section 100 may include threads 110 cooperative with internal threads 115 formed in the distal end 128 of the handle section 120 to that the handle section 120 and the core section 100 may be screwed together in coaxial alignment. Other attachment means (not shown) may be utilized as well to keep the core section 100 fixed in coaxial alignment with the handle section 120.

Figure 6:
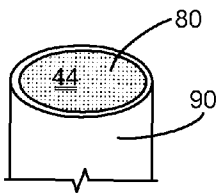
FIG. 6 is a partial perspective view of a junction sleeve of the invention.

In such an embodiment, a junction sleeve 90 is fixed around a junction 91 between the core section 100 and the handle section 120 (FIG. 3). Such a junction sleeve 90 includes the adhesive 80 on an inside surface 94 thereof (FIG. 6) for bonding the junction sleeve 90 at least partially around the core section 100 and the handle section 120. Further, preferably the forward sleeve 50 is fixed substantially around the core section 100 in such an embodiment, and at least partially around each semi-rigid rod 30 and at least partially around the handle section 120 (FIG. 2). Alternately, the forward sleeve 50 may just slightly contact each rod 30, if at all, and standard masking tape 130 (FIG. 2) may be used to selectively hold each rod 30 in the core section 100 at a selected relative position. Each sleeve 50,90 is a polyolefin sleeve material, such as used for forming each handle sleeve 70.

A resilient or semi-rigid tip 40 may be included that has a rod attachment aperture 60 therein for slidably receiving the distal end 38 of the nylon rod 30. The tip 40 is frictionally retained on the distal end 38 of the nylon rod 30. The distal end 38 of the nylon rod 30 may further include a radially-projecting lip 35 for retaining the tip 40 thereon (FIG. 3).

Preferably the center of gravity of the striker 10 is between 35% and 45% of the distance between the proximal end 32 of the handle 72 and the distal end 38 of each rod 30. Further, the core section 100 and the handle section 120 are each preferably hollow so that if a rod 30 gets fully lodged within the core section 100, a thin implement may be inserted into the proximal end of the handle 120 to traverse the interior hollow core section 100 to eject the rod 30 from the distal end 108 thereof, as necessary. A plastic or rubber open-ended cap 140 may be selectively attached to the proximal end 122 of the handle 120 and each handle sleeve 70 (FIGS. 1 and 2). Such a cap 140 may be weighted to adjust the balance of the striker 10 as desired.

While a particular form of the invention has been illustrated and described, it will be apparent that various modifications can be made without departing from the spirit and scope of the invention. For example, as illustrated in the figures, the core section 100 and the handle section 120 screw together with cooperative threads 110,115. However, other coaxial fastening means may be used, such as a mechanical snap arrangement (not shown), a J-shaped channel and pin arrangement (not shown), or the like. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the is invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A striker for a percussion instrument, comprising:

at least one elongated semi-rigid rod having a proximal end and a distal end;

an elongated tubular core section having a proximal end and a distal end, each rod slidably receivable in the distal end thereof;

at least one handle sleeve fixed around the proximal end of the core section;

an elongated tubular handle section having a proximal end and a distal end, the proximal end of the core section being fixedly receivable in the distal end thereof, the at least one handle sleeve fixed around the proximal end thereof; and a junction sleeve fixed around a junction between the core section and the handle section.

2. The striker of claim 1 wherein the junction sleeve includes the adhesive on an inside surface therein for bonding the sleeve at least partially around the core and handle sections.

3. The striker of claim 1 further including a forward sleeve fixed substantially around the core section.

4. The striker of claim 3 wherein the junction sleeve includes the adhesive on an inside surface therein for bonding the sleeve around the core section and at least partially around the semi-rigid rod and handle sections.

5. A striker for a percussion instrument, comprising:

at least one elongated semi-rigid rod having a proximal end and a distal end;

an elongated tubular core section having a proximal end and a distal end, each rod slidably receivable in the distal end thereof, the distal end of the semi-rigid rod including a radially-projecting lip for retaining the tip thereon;

at least one handle sleeve fixed around the proximal end of the core section; and a resilient tip having a rod attachment aperture for slidably receiving the distal end of the semi-rigid rod, the tip being frictionally retained on the distal end of the semi-rigid rod thereby.

6. The striker of claim 3 wherein each sleeve is a polyolefin shrink wrap sleeve.

7. A striker for a percussion instrument, comprising:

at least one elongated semi-rigid rod having a proximal end and a distal end;

an elongated tubular core section having a proximal end and a distal end, each rod slidably receivable in the distal end thereof;

at least one handle sleeve fixed around the proximal end of the core section; and an elongated tubular handle section having a proximal end and a distal end, the proximal end of the core section being fixedly receivable in the distal end thereof, the at least one handle sleeve fixed around the proximal end thereof, the proximal end of the core section including threads cooperative with internal threads formed in the distal end of the handle section, such that the handle section and the core section may be screwed together in coaxial alignment.

* * * * *